US009923281B2

(12) United States Patent
Maruyama et al.

(10) Patent No.: US 9,923,281 B2
(45) Date of Patent: Mar. 20, 2018

(54) DUAL ANTENNA SYSTEM

(71) Applicants: NTT DOCOMO, INC., Chiyoda-ku (JP); TOHOKU UNIVERSITY, Sendai-shi (JP)

(72) Inventors: Tamami Maruyama, Chiyoda-ku (JP); Yasuhiro Oda, Chiyoda-ku (JP); Jianfeng Li, Sendai (JP); Qiaowei Yuan, Sendai (JP); Qiang Chen, Sendai (JP); Kunio Sawaya, Sendai (JP)

(73) Assignees: NTT DOCOMO, INC., Chiyoda-ku (JP); TOHOKU UNIVERSITY, Shendai-shi (JP)

( * ) Notice: Subject to any disclaimer, the term of this patent is extended or adjusted under 35 U.S.C. 154(b) by 355 days.

(21) Appl. No.: 14/382,442

(22) PCT Filed: Jan. 15, 2013

(86) PCT No.: PCT/JP2013/050586
§ 371 (c)(1),
(2) Date: Sep. 2, 2014

(87) PCT Pub. No.: WO2013/136835
PCT Pub. Date: Sep. 19, 2013

(65) Prior Publication Data

US 2015/0155636 A1 Jun. 4, 2015

(30) Foreign Application Priority Data

Mar. 16, 2012 (JP) ..... 2012-061236

(51) Int. Cl.
*H01Q 21/29* (2006.01)
*H01Q 19/30* (2006.01)
(Continued)

(52) U.S. Cl.
CPC ..... *H01Q 21/29* (2013.01); *H01Q 1/246* (2013.01); *H01Q 9/0407* (2013.01);
(Continued)

(58) Field of Classification Search
CPC .... H01Q 21/29; H01Q 9/0407; H01Q 13/106; H01Q 19/30; H01Q 21/065
(Continued)

(56) References Cited

U.S. PATENT DOCUMENTS 6,037,911 A 3/2000 Brankovic et al.
2002/0140611 A1 10/2002 Ligander et al.
2011/0014878 A1 * 1/2011 Choudhury ..... H01Q 3/26 455/73

FOREIGN PATENT DOCUMENTS

DE 10 2004 017 358 A1 10/2005
JP 04-122102 A 4/1992
(Continued)

OTHER PUBLICATIONS

"Experimental Investigation of MIMO Performance Using Passive Repeater in Multipath Environment," by Wang, Qu, Li, Chen, Yuan and Sawaya, Antennas and Wireless Propagation Letters, IEEE, vol. 10, IEEE, 2011, pp. 752-755.*
(Continued)

*Primary Examiner* — Andrea Lindgren Baltzell
(74) *Attorney, Agent, or Firm* — Oblon, McClelland, Maier & Neustadt, L.L.P.

(57) ABSTRACT

A disclosed dual antenna system includes a receiving antenna which includes a first surface orthogonal to an incident wave, the first surface being a first antenna aperture, and a transmitting antenna which includes a second surface parallel to a reflection direction which is a transmission direction, the second surface being a second antenna aper-
(Continued)

ture. A portion of a structure of the transmitting antenna is shared by the receiving antenna.

10 Claims, 9 Drawing Sheets

(51) Int. Cl.

| | |
|---|---|
| ***H01Q 9/04*** | (2006.01) |
| ***H01Q 13/10*** | (2006.01) |
| ***H01Q 13/08*** | (2006.01) |
| ***H01Q 21/00*** | (2006.01) |
| ***H01Q 1/24*** | (2006.01) |
| ***H01Q 21/06*** | (2006.01) |
| ***H01Q 9/06*** | (2006.01) |

(52) U.S. Cl.
CPC ..... *H01Q 9/065* (2013.01); *H01Q 13/085* (2013.01); *H01Q 13/106* (2013.01); *H01Q 19/30* (2013.01); *H01Q 21/0075* (2013.01); *H01Q 21/065* (2013.01)

(58) Field of Classification Search
USPC ..... 343/730
See application file for complete search history.

(56) References Cited

FOREIGN PATENT DOCUMENTS

| | | | |
|---|---|---|---|
| JP | 2004-312397 | A | 11/2004 |
| JP | 2010-124194 | A | 6/2010 |
| WO | WO 2005/036694 | A2 | 4/2005 |

OTHER PUBLICATIONS

Extended European Search Report dated Oct. 23, 2015 in Patent Application No. 13761126.5.

Office Action dated Jun. 8, 2016 in European Patent Application No. 13 761 126.5.

International Search Report dated Apr. 16, 2013 in PCT/JP2013/050586 filed Jan. 15, 2013.

Office Action dated Jul. 2, 2013 in Japanese Patent Application No. 2012-061236 (with English language translation).

Lin Wang, et al., "Experimental Investigation of MIMO Performance Using Passive Repeater in Multipath Environment" IEEE Antennas and Wireless Propagation Letters, vol. 10, 2011, pp. 752-755.

Tamami Maruyama, et al., "Capacitance Value Control for Metamaterial Reflectarray using Multi-layer Mushroom Structure with Parasitic Patches", Aces Journal, vol. 27, No. 1, Jan. 2012, pp. 28-41.

P. A. Belov, et al., "Strong Spatial Dispersion in Wire Media in the Very Large Wavelength Limit", URSI EMTS 2004, pp. 621-623.

Olli Luukkonen, et al., "Simple and Accurate Analytical Model of Planar Grids and High-Impedance Surfaces Comprising Metal Strips or Patches", IEEE Transactions on Antennas and Propagation, vol. 56, No. 6, Jun. 2008, pp. 1624-1632.

Olli Luukkonen, et al., "Effects of Spatial Dispersion on Reflection From Mushroom-Type Artificial Impedance Surfaces" , IEEE Transactions on Microwave Theory and Techniques, vol. 57, No. 11, Nov. 2009, pp. 2692-2699.

David M. Pozar, et al., "Design of Millimeter Wave Microstrip Reflectarrays" , IEEE Transactions on Antennas and Propagation, vol. 45, No. 2, Feb. 1997, pp. 287-296.

Shi-Wei Qu, et al., "Dual-Antenna System Composed of Patch Array and Planer Yagi Antenna for Elimination of Blindness in Celluler Mobile Communications" Progress in Electromagnetics Research C, vol. 21, 2011, pp. 87-97.

Bevan B. Jones, et al., "The Synthesis of Shaped Patterns with Series-Fed Microstrip Patch Array", IEEE Transactions on Antennas and Propagation, vol. AP-30, No. 6, Nov. 1982, pp. 1206-1212.

Office Action dated Feb. 22, 2017 in European Patent Application No. 13761126.5.

* cited by examiner

DUAL ANTENNA SYSTEM

TECHNICAL FIELD

The present invention relates to a dual antenna system.

BACKGROUND ART

In a wireless communication system, there is a case where radio waves from a base station installed on a rooftop of a building are blocked by obstacles such as other buildings. This kind of problem becomes serious especially in urban areas or narrow streets. The areas in which radio waves are blocked by obstacles are called blind spots.

One of the methods dealing with this kind of problem is to use an RF booster. However, not only it is required that the RF booster include devices such as a receiver, an amplifier, a transmitter, etc., but also it is required that the RF booster be fed with power to operate, which generally leads to complexity and high cost. As a result, it is difficult to easily install many apparatuses of this kind of RF boosters in various places.

Also, there is a technology in which received radio waves are re-radiated in an intended direction by using a dual antenna system in which a receiving antenna and a transmitting antenna are combined (regarding this technology, refer to non-patent documents 1 and 2). Although the dual antenna system does not require power from the power supply, the amplifier, etc., it still requires a three dimensional structure with a complicated wiring pattern.

Therefore, a simple dual antenna system that is capable of receiving radio waves from a certain direction and capable of transmitting them in an intended direction is awaited in this technology field.

RELATED ART DOCUMENT

[Non-Patent Document 1]
Lin Wang, et al., "Experimental Investigation of MIMO Performance Using Passive Repeater in Multipath Environment", IEEE ANTENNAS AND WIRELESS PROPAGATION LETTERS, VOL. 10, 2011, PP. 752-755
[Non-Patent Document 2]
Shi-Wei Qu, et al., Progress In Electromagnetics Research C, Vol. 21, 87-97, 2011
[Non-Patent Document 2]
Jones, et al., "The Synthesis of Shaped Patterns with Series-Fed Microstrip Patch Array", IEEE TRANSACTIONS ON ANTENNAS AND PROPAGATION, VOL. AP-30, NO. 6, November 1982, PP. 1206-1212

SUMMARY OF THE INVENTION

Problem to be Solved by the Invention

A problem to be solved by the present invention is to provide a simple dual antenna system that is capable of receiving radio waves from a certain direction and capable of transmitting them in an intended direction.

Means for Solving the Problem

A dual antenna system according to the present embodiment includes a receiving antenna configured to include a first surface orthogonal to an incident wave, the first surface being a first antenna aperture, and a transmitting antenna configured to include a second surface parallel to a reflecting direction which is a transmitting direction, the second surface being a second antenna aperture. A portion of a structure of the transmitting antenna and is shared by the receiving antenna.

Effect of the Present Invention

According to the present embodiment, a simple dual antenna system that is capable of receiving radio waves from a certain direction and capable of transmitting them in an intended direction can be provided.

EMBODIMENTS FOR CARRYING OUT THE INVENTION

Figure 1:
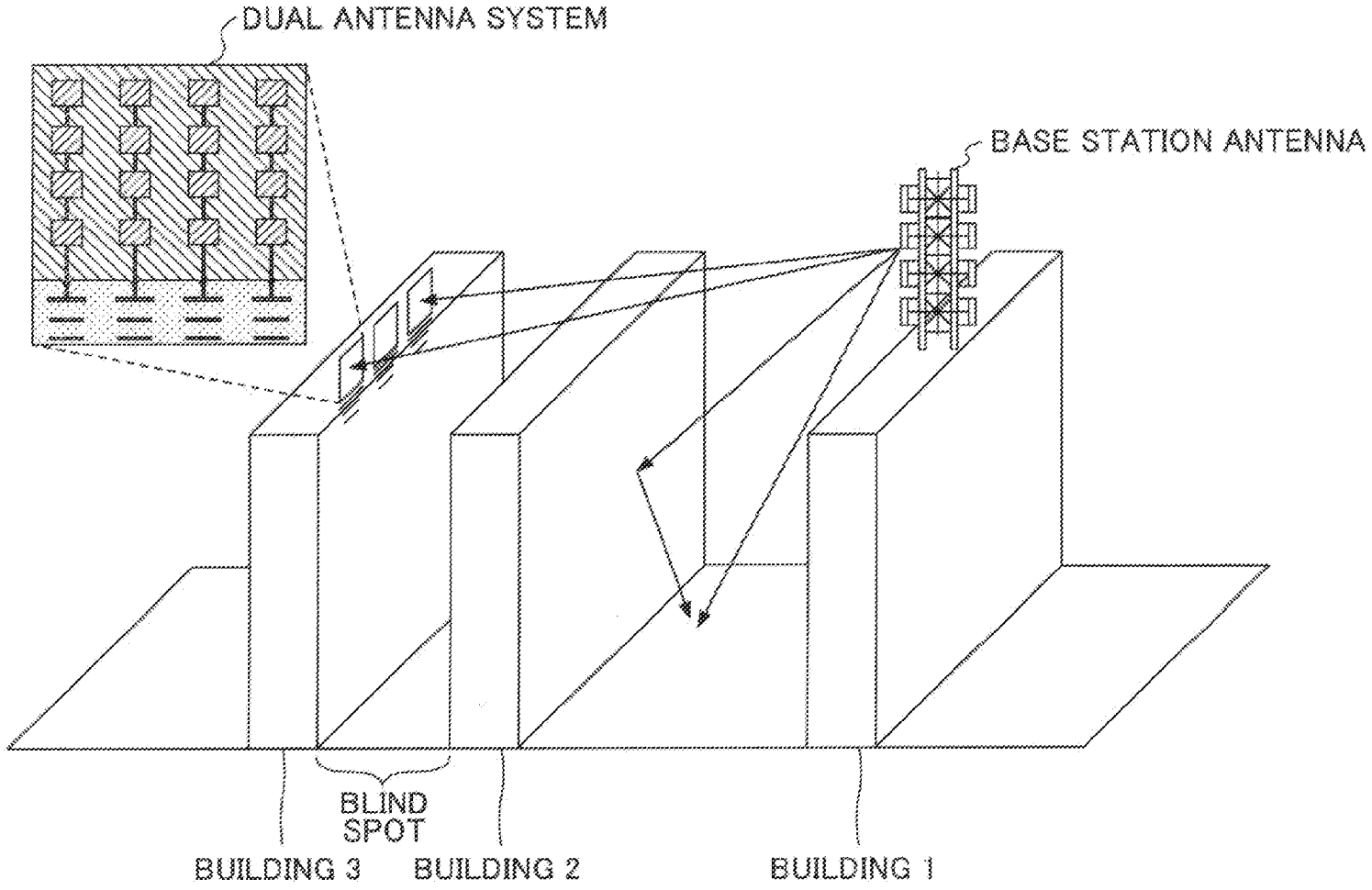
FIG. 1 is a drawing illustrating an example of a communication environment in which a dual antenna system according to the present embodiment is used.

In the following, the present embodiment will be described referring to the accompanying drawings from the following viewpoints. Throughout the figures, the same reference numbers or codes are given to the same elements.

1. Overview
2. Structure
2. 1 Receiving antenna
2. 2 Transmitting antenna
2. 3 Dual antenna system
3. Modified embodiment
3. 1 Direction of radio waves
3. 2 Types of receiving/transmitting antennas

1. Overview

FIG. 1 shows an example of a communication environment in which a dual antenna system according to the present embodiment is used. In this communication environment, there exist a building 1, a building 2 and a building 3, and an antenna of a base station is installed on the rooftop of the building 1. A user in an area between the building 1 and the building 2 can receive radio waves from the base station with good quality. However, a user in an area between the building 2 and the building 3 cannot receive the radio waves from the base station with good quality. Therefore, unless appropriate measures are taken, the area becomes a blind spot.

In order to avoid creating blind spots, a dual antenna system according to the present embodiment is installed on the rooftop of the building 3. The detailed description of the dual antenna system will be provided later. In general, the dual antenna system receives radio waves from the base station using its receiving antenna and transmits the received radio waves using its transmitting antenna so that the radio waves reach the user between the building 2 and the building 3. The dual antenna system according to the present embodiment, different from the traditional dual antenna system, does not require the three dimensional complicated wiring pattern, etc., and includes a simple and fit-for-manufacturing planar structure, which facilitates the easy designing.

2. Structure

In the following, the structure of the dual antenna system is described with specific example numbers. The numbers are just examples, and other numbers may be used as necessary.

Figure 2:
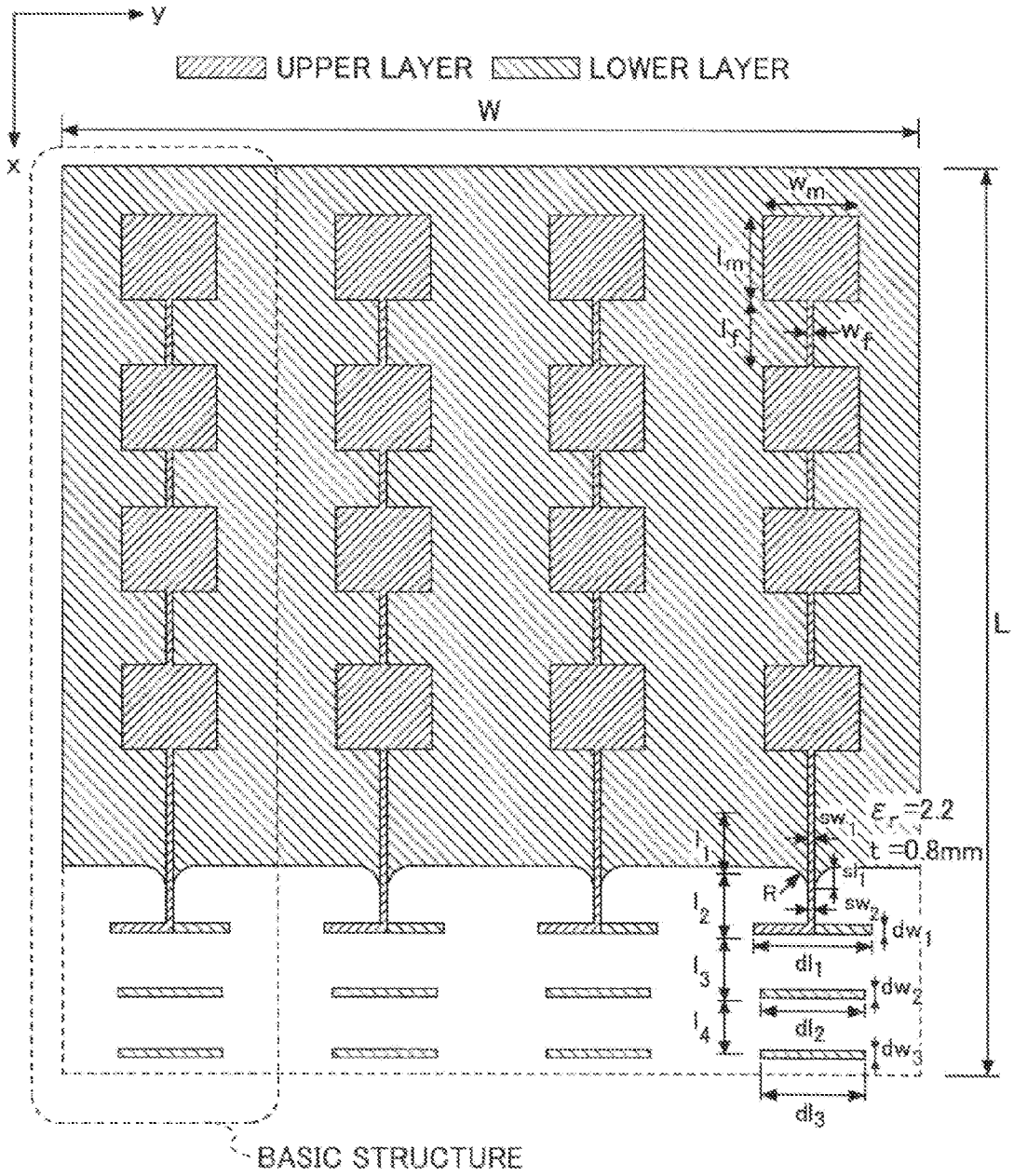
FIG. 2 is a drawing illustrating a top view of the dual antenna system.

In FIG. 2, the top view of the dual antenna system in FIG. 1 is shown. The dual antenna system includes a basic structure, surrounded by a short dashed line which extends in the x-axis direction. The dual antenna system includes as many as four basic structures in the y-axis direction. In general, the dual antenna system can include one or more of the basic structures. The dual antenna system shown in the figure, in general, includes an upper layer, a lower layer and a substrate layer between the two layers. The lower layer includes at least a part which functions as a base plate, a ground plate or a ground. The upper layer includes a conductive layer of a pattern of a predefined or geometric shape. The substrate layer has the thickness of 0.8 mm and the relative permittivity of 2.2. Because the lower layer, the substrate layer and the upper layer are layered in this order in the z-axis direction, in the case where the dual antenna system is viewed from the top, the lower layer actually cannot be seen, but for the sake of description convenience, the upper layer and the lower layer are transparently drawn in FIG. 2.

In general, the dual antenna system receives waves of 2 GHz coming from the z axis +∞ direction, and transmits the received waves in the x axis direction. As an example, the dual antenna system including the four basic structures shown in the figure has a length l of 589 mm in the x axis direction and a width w of 471.6 mm in the y axis direction. Note that it is not essential for the present embodiment that the frequency of the wave be 2 GHz. The present embodiment can be used for the radio waves of other frequencies such as 11 GHz and the frequency of the radio wave can be any frequency.

Figure 3:
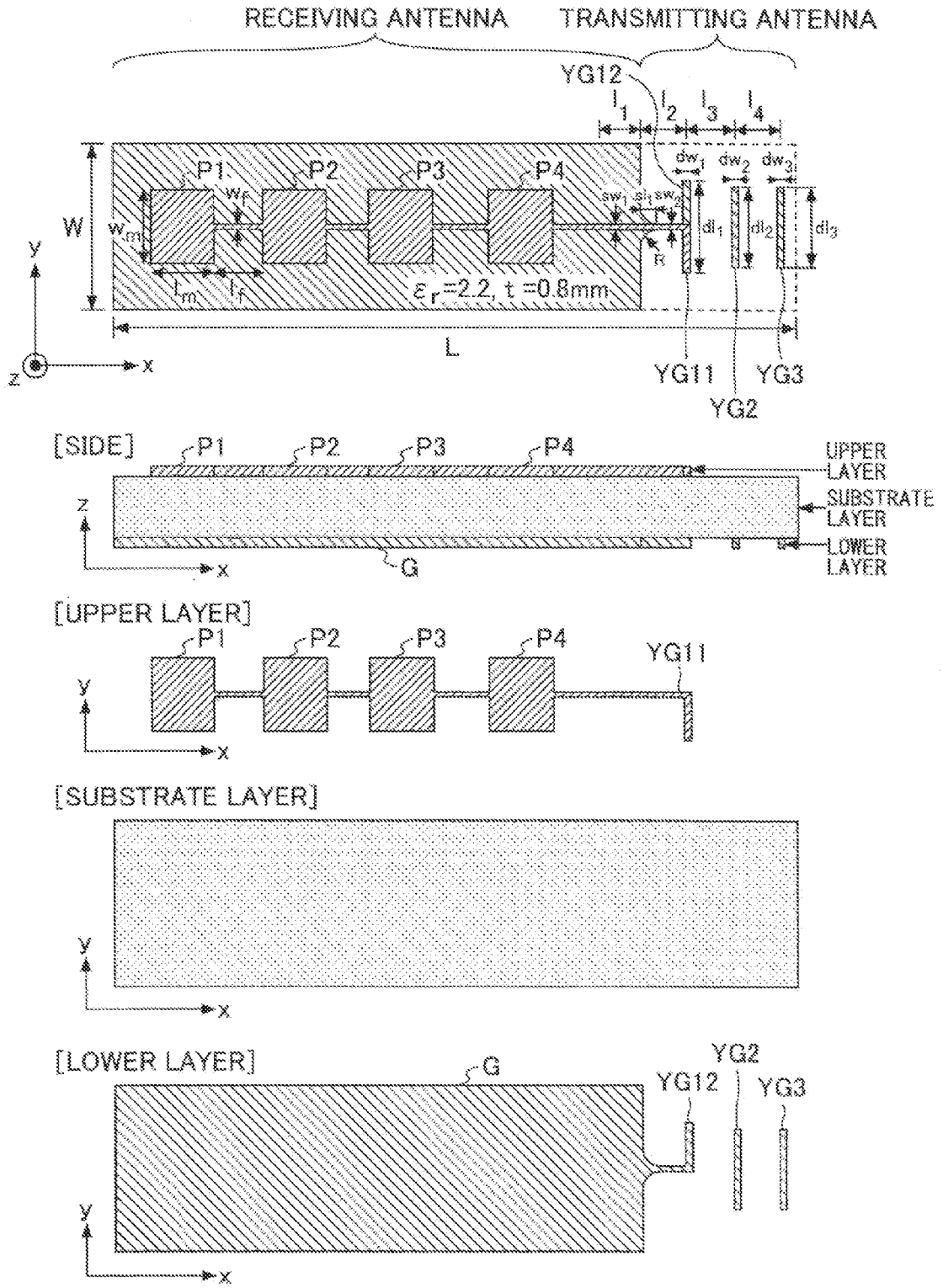
FIG. 3 is a drawing illustrating a basic structure of the dual antenna system.

FIG. 3 is a detailed drawing of the basic structure in FIG. 2. FIG. 3 shows, starting from the top, a top view, a side view, a top view of the upper layer, a top view of the substrate layer and a top view of the lower layer. In general, the basic structure includes a part functioning as a receiving antenna and a part functioning as a transmitting antenna. The receiving antenna and the transmitting antenna are formed as planar antennas. As an example, they are formed as microstrip antennas. Note that it is not essential that both the receiving antenna and the transmitting antenna, which constitute the basic structure shown in the figure, include the three-layer structure: the lower layer, the substrate layer and the upper layer. Especially, regarding the substrate layer of the transmitting antenna shown in the figure, all or part of it may not exist.

<2. 1 Receiving Antenna>

The receiving antenna is a non-power-fed passive antenna with a surface orthogonal to the incident waves, the surface being an antenna aperture, which transforms radio waves received from the z axis +∞ direction into high frequency energy, and provides the high frequency energy to the transmitting antenna. The receiving antenna includes four patches P1 through P4, which are connected serially in line along the x axis direction, the four patches are placed on the substrate layer, and the substrate layer is placed on the base plate. As many as four patches are used for the sake of drawing simplicity, but the number of patches to be used can be changed accordingly depending on the intended use. The patch length $l_m$ and the patch width $w_m$ of each of the patches are 49.50 mm and 58.95 mm, respectively. The line length $l_f$ and the line width $w_f$ of the line connecting the adjacent patches are 50.20 mm and 1.3 mm, respectively. The length in the x axis direction and the width in the y axis direction of the receiving antenna are 424.9 mm and 117.9 mm, respectively. Note that it is described in non-patent document 3 that multiple patches are connected serially.

Because the four patches P1 through P4 shown in FIG. 3 are connected serially in line, the sum of the lengths of the lines that connect each of the patches in the same plane becomes the shortest. In the case where the four patches are connected to the transmitting antenna, for example, in parallel, four long lines which connect the patches and the transmitting antenna become required. But in the case of the present embodiment, because the sum of the lengths of the lines that connect each of the patches is minimized, the power leaking out from the lines can be also minimized. In the above examples of the values, the length $l_m$ of the patch and the length $l_f$ of the connecting line (or spacing) are about 5 cm, which corresponds to the half wavelength of the 2 GHz radio wave (7.5 cm). This is preferable from the viewpoint of expanding the band width while ensuring sufficient separation of the patches to avoid the inter-coupling of the patches, and from the viewpoint of suppressing sidelobes. The thickness and the permittivity of the substrate decide the characteristic impedance of the strip line, and parameters such as the line width are selected in accordance with the impedance.

Figure 4:
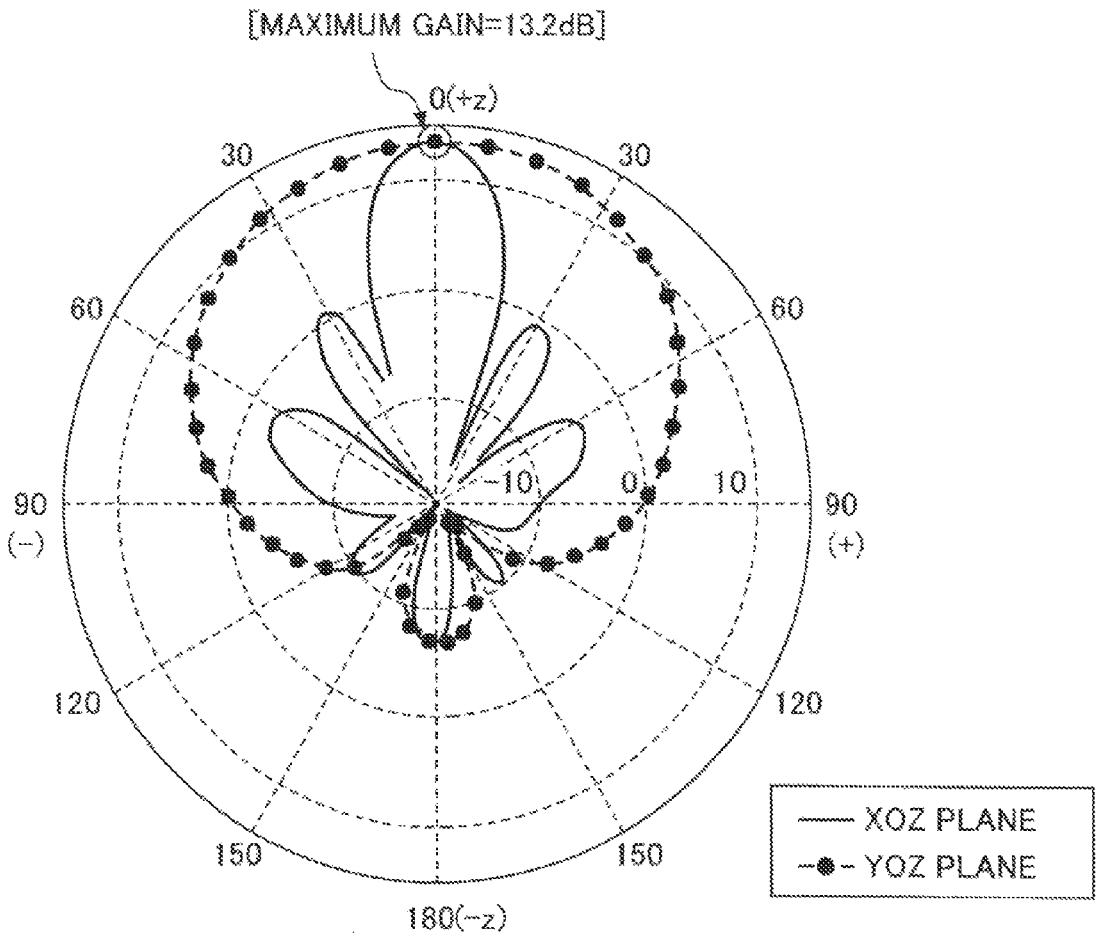
FIG. 4 is a drawing illustrating independent operating characteristics of a receiving antenna.

The operating characteristics shown in FIG. 4 are operating characteristics shown in the case where the receiving antenna portion alone shown in FIG. 3 is assumed to exist independently. FIG. 4 shows the gains of the receiving antenna in the direction in the xoz plane and in the yoz plane. The z axis +∞ direction is a direction from which the radio waves are coming, and the x axis direction is a direction in which multiple patches are lined up in line and at the same time is a direction in which the radio waves are transmitted. As is shown in the figure, there is a big gain indicated in the direction from which the radio waves are coming (0 degrees direction), and the gain reaches 13.2 dB at the maximum.

<2. 2 Transmitting Antenna>

The transmitting antenna is a non-power-fed passive antenna with a surface parallel to the reflection direction which is the transmission direction, the surface being an antenna aperture, and transforms the high frequency energy transformed based on the radio waves received by the receiving antenna into the radio waves re-radiated in the intended direction.

The transmitting antenna shown in FIG. 3 forms a Yagi-Uda antenna. The transmitting antenna includes a line YG11 connected to the patch P4 of the receiving antenna in the upper layer and three lines YG12, YG2 and YG3 placed in the lower layer.

Figure 5:
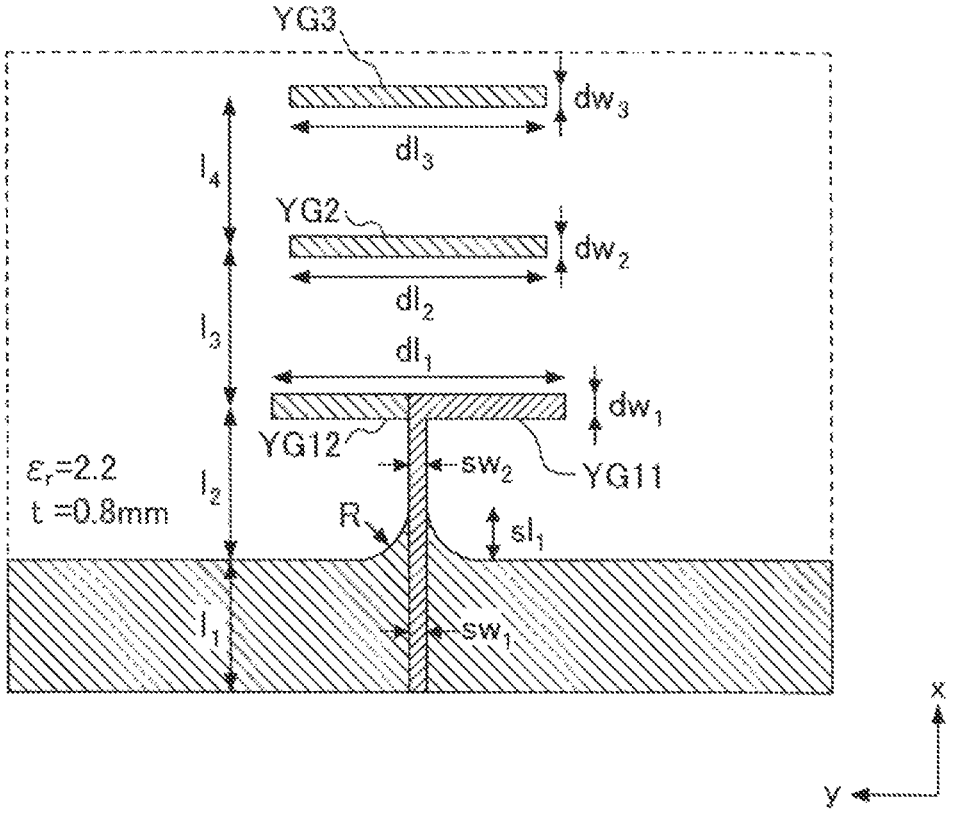
FIG. 5 is a detailed drawing of a transmitting antenna.

FIG. 5 shows a detailed drawing of the transmitting antenna. The metal strip YG11 is connected to the patch P4 of the receiving antenna in the same plane, the metal strip YG12 is connected to the base plate of the receiving antenna in the lower layer, and YG11 and YG12 together constitute a print dipole and function as a driven element of the Yagi-Uda antenna. YG11 includes a line portion along the x axis direction and a metal strip portion along the y axis direction. The metal strip portion along the y axis acts as an antenna element. The line portion along the x axis gradually becomes greater in width as it goes in the x axis + direction. In an example shown in the figure, the line width becomes greater from sw1=1.3 mm to sw2=2.286 mm. The portion along the y axis direction includes the constant line width dw1=5.5 mm. The metal strip YG12 is connected to the base plate in the same plane, includes a geometric shape that is symmetrical to the base plate YG11 of the upper layer, and, together with the line YG11, forms a print dipole. YG12 also includes a line portion along the x axis direction and a metal strip (antenna element) portion along the y axis direction. The line portion along the x axis direction includes a line width of sw2=2.86 mm and is connected to the base plate along the arc of curvature radius $sl_1$=17.2 mm. The portion along the y axis direction includes a constant line width dw1=5.5 mm. The portions along the y axis direction of the lines YG11 and YG12 are both the distance $l_2$=33 mm away from the end face of the base plate.

YG2 and YG3 are both formed in the lower layer, and function as passive elements or waveguide elements (directors) of the Yagi-Uda antenna. In the present embodiment, the waveguide elements YG2 and YG3 shown in the figure are placed in the same plane as the base plate and the line YG12. Note that the waveguide elements may be placed in the upper layer. The waveguide element YG2 is placed the distance $l_3$=34.25 mm away from the waveguide element YG11, and its line length dl2 and line width dw2 are 55 mm and 4 mm. The waveguide element YG3 is placed the distance l4=33 mm away from the waveguide element YG2, and its line length dl3 and line width dw3 are 55 mm and 4 mm. Note that two lines YG2 and YG3 are used as waveguide elements of the Yagi-Uda antenna. The number of the lines used as waveguide elements can be any number. In the present embodiment, the Yagi-Uda antenna that acts as a transmitting antenna includes the base plate of the receiving antenna as a reflection element and comprises driven elements including YG11 and YG12 and waveguide elements including YG2 and YG3. In other words, in the present embodiment, the reflecting element of the Yagi-Uda antenna that acts as a transmitting antenna is also used as the base plate of the series feeding microstrip antenna that acts as a receiving antenna.

Figure 6:
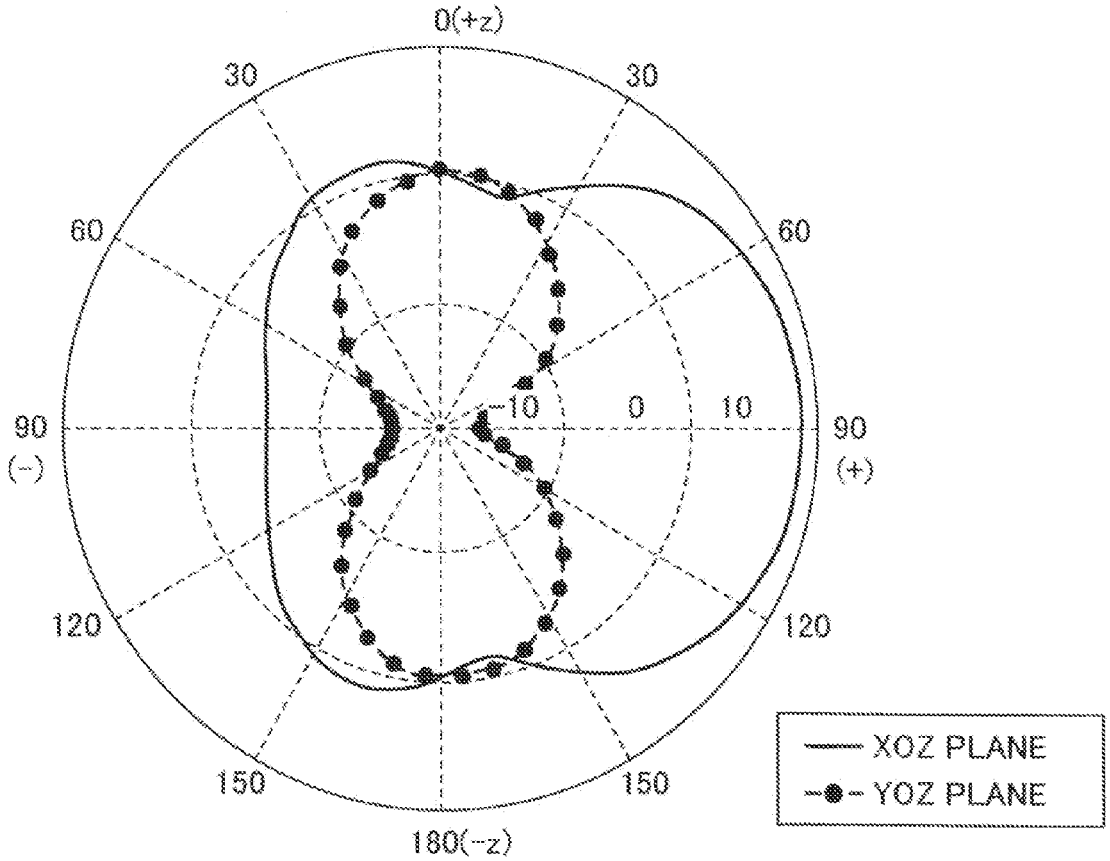
FIG. 6 is a drawing illustrating independent operating characteristics of the transmitting antenna.

The operating characteristics shown in FIG. 6 are operating characteristics shown in the case where the transmitting antenna portion shown in FIG. 5 is assumed to exist alone independently. FIG. 6 shows the gain of the transmitting antenna with respect to the direction in the xoz plane and in the yoz plane. The z axis +∞ direction is a direction from which the radio waves are received, and the x axis is a direction in which the radio waves are transmitted. As shown in the figure, in the xoz plane, a big (8.3 db or more) gain is obtained in the intended direction (the x axis + direction).

Figure 7:
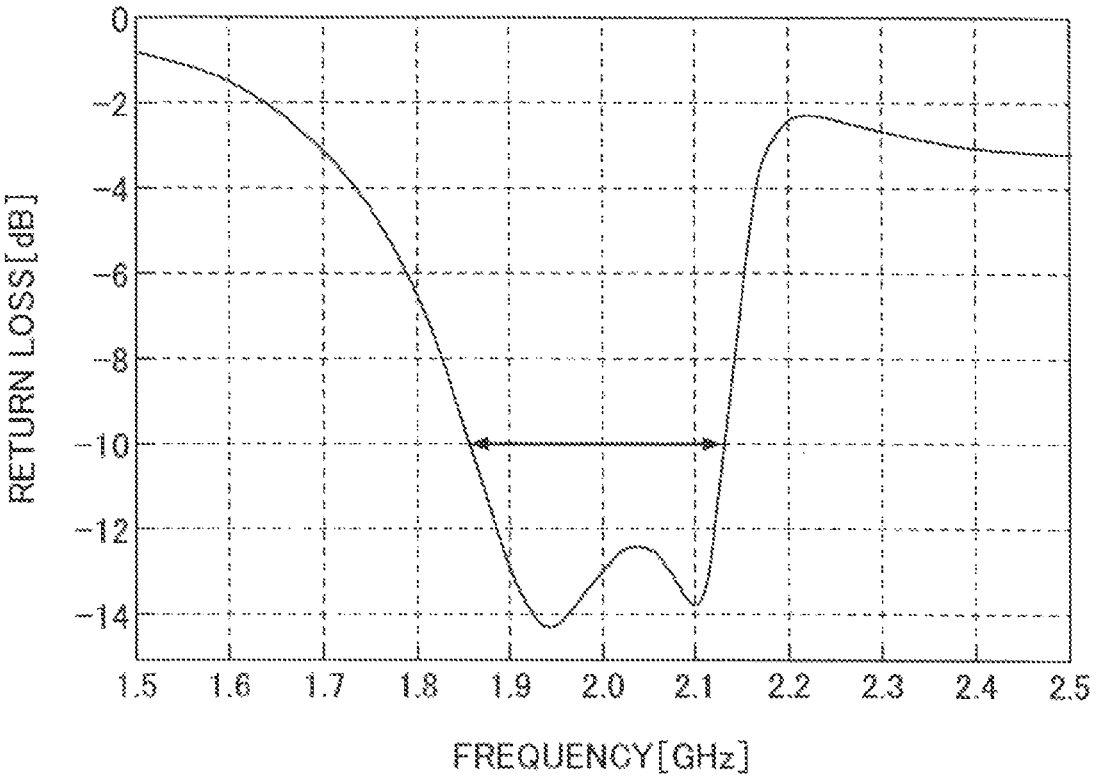
FIG. 7 is a drawing illustrating frequency dependency of the return loss.

FIG. 7 shows a frequency dependency of the return loss for the Yagi-Uda antenna configured with the above examples of numbers (FIG. 3 and FIG. 5). It is shown in the figure that the loss is very low at the frequencies around 2 GHz which is used for the radio waves. Note that it is not essential for the present embodiment that the frequency of the wave used be 2 GHz. The present embodiment can be used for the radio waves of any frequency such as 11 GHz.

<2. 3 Dual Antenna System>

The basic structure of the dual antenna system is obtained by connecting the above receiving antenna and the transmitting antenna in the same plane. By arranging one or more basic structures, the dual antenna system that can receive and reflect the radio waves with the intended strength can be obtained (FIG. 2). For example, in an embodiment in FIG. 2, as many as four basic structures are arranged, and the transmitting antenna includes an array of four four-element (one reflector, one driven element and two directors) Yagi-Uda arrays while the receiving antenna includes a four by four (series feeding) microstrip array. It is shown that, by arranging in arrays, the antenna apertures of the antennas are made large and the values of the scattering cross-section can be made large. The radio waves received by each of the patches P1 through P4 of the receiving antenna are transformed into high frequency energy, and the high frequency energy is transmitted to the transmitting antenna through the lines that connect the patches. The high frequency energy is transformed into the radio waves that are caused to be re-radiated in the intended direction by the transmitting antenna. It should be noted that, in this case, the patches of the receiving antenna, the driven element of the transmitting antenna and the lines that connect them are in the same plane. By this, it becomes easy to design and manufacture dual antenna systems.

Figure 8:
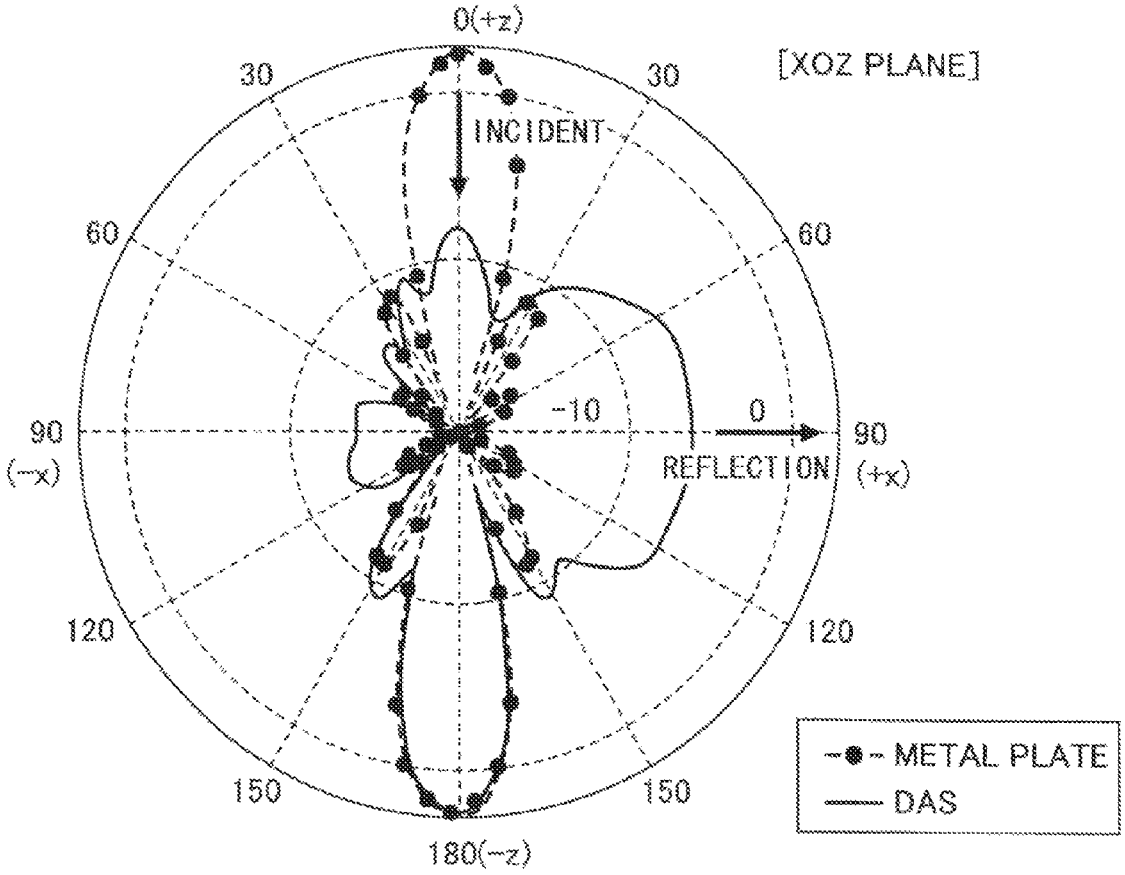
FIG. 8 is a drawing illustrating operating characteristics of the dual antenna system.

FIG. 8 shows operating characteristics of the dual antenna system (DAS) according to the present embodiment in the xoz plane. In FIG. 8, the solid line denotes the result of the DAS. It should be noted that while the dual antenna system includes the receiving antenna and the transmitting antenna, the operating characteristics in FIG. 8 are not just a simple summation of the independent operating characteristics of the receiving antenna (FIG. 4) and the independent characteristics of the transmitting antenna (FIG. 6). The z axis +∞ direction is a direction from which the radio waves are received. The x axis is a direction in which the radio waves are transmitted. For the purpose of comparison, the characteristics of the metal plate with the same dimensions are shown in the short-dashed line. In the case of the metal plate, large gains are obtained in the specular reflection direction (zero degrees) with respect to the incident direction (zero degrees) and in the 180 degrees direction (back-lobe direction) which is the same as the incident direction, and a gain only nearly equal to zero is obtained in the intended direction of the 90 degrees direction. On the other hand, in the case of the dual antenna system (DAS) according to the present embodiment, the forward scattering (reflection in the zero degrees direction) is reduced by 10 dB or more compared to the case of the metal plate, which indicates that the aperture efficiency of the dual antenna system is extremely good. Furthermore, in the x axis + direction, the maximum gain of −5.8 dBsm is shown at θ=60 degrees, and the stable and high gains of from −6.3 dBsm through −5.8 dBsm are obtained throughout the wide angle range of from 60 degrees through 120 degrees. Therefore, according to the present embodiment, the incident waves can be reflected strongly in the orthogonal direction, and this kind of effect has not been achieved by traditional planar type structures such as a reflecting plate or a microstrip reflectarray. In the case of the traditional planar type structures such as a microstrip reflectarray, planes orthogonal to the incident waves and the reflected waves act as antenna apertures and directly affect the gains. Therefore, in the case of planar patch type elements of this kind being used for the reflectarray structure, it was impossible to radiate with high gain in a direction orthogonal to the plane. In other words, it was impossible to include a large area orthogonal to the plane.

On the other hand, in the present embodiment, a Yagi-Uda array is included in the same plane as the receiving planar array. Regarding the Yagi-Uda array, the high gain is obtained by placing the elements in line in the same direction as the radiating direction. In other words, because as much the long length can be included in the array direction even if the area of the antenna orthogonal to the transmission direction is small as in the present embodiment, the large enough antenna aperture can be obtained (thickness of the substrate*length in the y direction=area). In other words, by combining the series feeding microstrip and the Yagi-Uda antenna, such a reflectarray is realized for the first time that has a planar structure and yet has a high gain in the 90 degrees direction.

By placing in number the simple and less expensive basic structure of the dual antenna system according to the present embodiment as many as required, the radiation characteristics of the radio wave transmitted in the x axis direction can be improved. Also, by increasing the number of the patches in the dual antenna system, the radiation characteristics of the radio wave transmitted in the x axis direction can be improved. According to the present embodiment, by utilizing the simple structure in which the receiving antenna, in which multiple patches are connected in line, and the Yagi-Uda antenna are connected in the same plane; together with the radiation characteristics of those antennas, the radio waves incident along the z axis can be effectively reflected in the x axis direction.

3. Modified Embodiment

<<3. 1 Direction of Radio Waves>>

In the above description, the radio waves are coming from the incident direction of the z axis +∞ direction, and the transmission waves (reflected waves or scattered waves) are re-radiated in the x axis + direction (intended direction). In this case, the angle between the incident direction and the intended direction is not necessarily 90 degrees. For example, because relatively high gains are obtained in the range from +60 degrees to +120 degrees as shown in FIG. 8, the intended direction may not necessarily match exactly the x=y=0 direction (θ=90 degrees). In other words, the angle of the intended direction θ may be off from the 90 degrees. Or, when the transmitting antenna is connected to the receiving antenna, the transmitting antenna may be connected to the receiving antenna in such a way that the angle of the direction, in which the transmitting antenna is extended, with respect to the z axis may be not the right angle. Also, regarding the receiving antenna, the direction in which the four patches P1 through P4 are placed in line may not be exactly along with the x axis. For example, the direction in which the patches are placed in line may have a non-zero angle with respect to the x axis.

<<3. 2 Types of Receiving/Transmitting Antennas>>

In the present embodiment described above, the receiving antenna has a structure in which multiple patches are connected in line, but the present invention is not limited to the above specific embodiment. Any appropriate antenna, which is capable of receiving radio waves, transforming them into high frequency energy, and providing it to the transmitting antenna, can be used. Note that from the viewpoint of efficiently providing the received radio waves to the transmitting antenna, it is preferable that the receiving antenna include a structure in which the multiple patches of about the half wavelength are serially connected in the same plane.

The transmitting antenna is not limited to the Yagi-Uda antenna, and any appropriate antenna, which is capable of transmitting the high frequency energy in the intended direction, can be used. Especially, the present embodiment can provide an effect of transmitting the radio waves with a big gain in the 90 degrees direction regardless of the shape of the antenna as long as the receiving antenna is a receiving antenna 1 (e.g., microstrip array) which can increase the gain by increasing the area orthogonal to the receiving direction (incident direction); and the transmitting antenna is a transmitting antenna 2 (e.g., Yagi-Uda antenna) which can increase the gain by increasing the element (area) parallel to the transmission direction (reflection direction). Furthermore, the present embodiment can provide the effect by using any element as long as the base plate of the receiving antenna 1 is also used as the reflector (reflection plate) of the transmitting antenna 2; and each of the elements of the receiving antenna 1 is connected to the driven element of the transmitting antenna 2 by the line.

Figure 9:
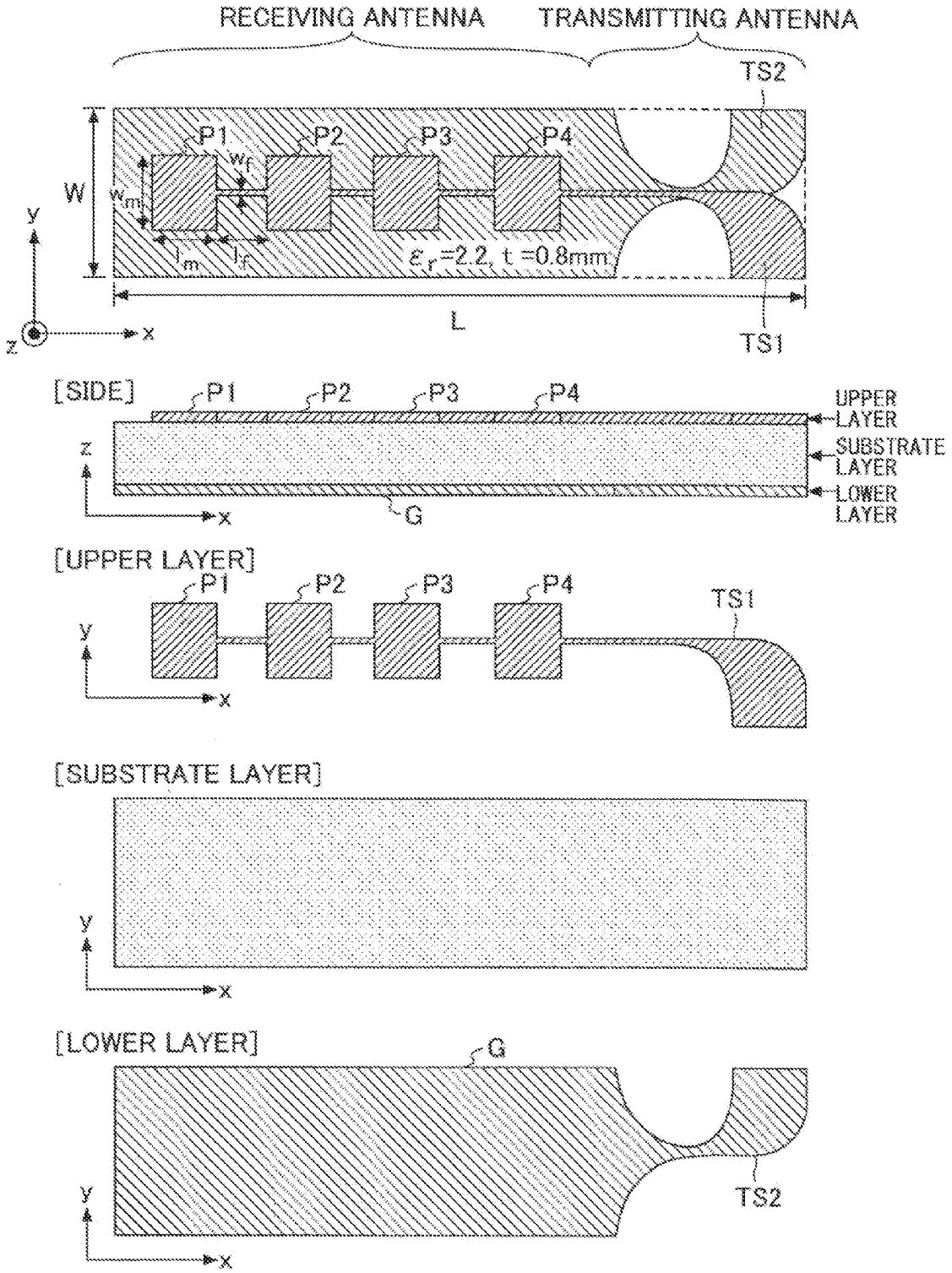
FIG. 9 is a drawing illustrating a basic structure of the dual antenna system in which an alternative transmitting antenna is used.

FIG. 9 shows a dual antenna system in which, instead of the Yagi-Uda antenna, a tapered slot antenna is used as the transmitting antenna. As for the receiving antenna, it is the same as what is described referring to FIG. 3 and FIG. 4. In an embodiment shown in FIG. 9, the transmitting antenna includes a conductive element TS1 which is connected to the patch P4 of the receiving antenna in the same plane in the upper layer and a conductive element TS2 which is connected to the base plate in the same plane in the lower layer, and there is the substrate layer between the conductive elements TS1 and TS2. The conductive element TS1 in the upper layer and the conductive element TS2 in the lower layer have geometric shapes which are symmetric to each other with respect to the straight line parallel to the x axis (the straight line that includes the lines connecting the patches). The shape shown in FIG. 9 is an example of the shape for the tapered slot antenna, and other tapered slot shapes may be used. According to the present modified embodiment, by utilizing the simple structure in which the receiving antenna, in which multiple patches are connected in line, and the tapered slot antenna are connected in the same plane; together with the radiation characteristics of those antennas, the radio waves incident along the z axis can be effectively reflected in the x axis direction.

As described above, the transmitting antenna may be any appropriate antenna which is capable of transmitting the high frequency energy in the intended direction. Note that, from the viewpoint of the simple and small dual antenna system which re-radiates the incident waves in the nearly orthogonal direction, it is preferable that the receiving antenna, in which multiple patches are connected in line, and the Yagi-Uda antenna or the tapered slot antenna be connected in the same plane.

Also, regarding the above configuration, the transmitting antenna and the receiving antenna may be switched. In other words, the radio waves received by the Yagi-Uda antenna can be transmitted by the series feeding microstrip antenna.

As described above, the dual antenna system is described using the embodiments. The present invention is not limited to the above embodiments and various modifications and improvements are available within the scope of the present invention. For example, the present invention may be applied to any appropriate system which receives radio waves coming from a certain direction and re-radiates them in another direction. For the sake of convenience, the present embodiments are described using specific numbers in order to facilitate understanding of the invention, but these numbers are used just as examples and, unless otherwise noted, any appropriate number can be used. For the sake of convenience, the present embodiments are described using specific mathematical expressions in order to facilitate understanding of the invention, but these mathematical expressions are used just as examples and, unless otherwise noted, other mathematical expressions that can produce the same results may be used. Division of embodiments or items is not essential for the present invention, and things described in two or more items may be used in combination as necessary, or a thing described in an item may be applied to a thing described in a different item (as long as it does not conflict).

The present application is based on and claims the benefit of priority of Japanese Priority Application No. 2012-061236 filed on Mar. 16, 2012, the entire contents of which are hereby incorporated by reference.

DESCRIPTION OF THE REFERENCE NUMERALS

DAS Dual antenna system

1, 2, 3 Building or obstacle

The invention claimed is:

1. A dual antenna system comprising:

a receiving antenna that includes a plurality of patches disposed on an upper surface of a substrate and a base plate disposed on a lower surface of the substrate, an antenna aperture of the receiving antenna being determined in a surface orthogonal to a radio wave receiving direction, and a transmitting antenna that includes an upper driven element which is disposed on the upper surface of the substrate and connected to the patches, a lower driven element which is disposed on the lower surface of the substrate and connected to the base plate and the base plate serving as a reflection plate;

wherein an antenna aperture of the transmitting antenna is provided in a surface parallel to a radio wave transmitting direction, and wherein the patches, the upper driven element, and lines that connect the patches and the upper driven element are located in a first common plane, and the base plate and the lower driven element are located in a second common plane, and wherein the second common plane including the base plate, the substrate, and the first common plane including the patches are layered in this order in the wave receiving direction.

2. The dual antenna system as claimed in claim 1, wherein the receiving antenna and the transmitting antenna are passive and are not fed with power; the patches and the upper driven element are connected in line by a line; and high frequency energy received by the receiving antenna is transmitted to the driven upper element via the line.

3. The dual antenna system as claimed in claim 1, wherein the transmitting antenna is a Yagi-Uda array including one or more directors.

4. The dual antenna system as claimed claim 1, wherein the driven elements of the transmitting antenna are a pair of antennas including two metal strips.

5. The dual antenna system as claimed in claim 4, wherein the pair of antennas as the driven element of the transmitting antenna is a tapered slot antenna.

6. The dual antenna system as claimed in claim 1, wherein the transmitting antenna is a print dipole antenna.

7. The dual antenna system as claimed in claim 1, wherein the upper and lower driven elements have symmetric geometric shapes.

8. The dual antenna system as claimed in claim 1, wherein the patches are placed on one part of the upper surface of the substrate and the upper driven element is placed on another part of the upper surface of the substrate.

9. The dual antenna system as claimed in claim 1, wherein the receiving direction is orthogonal to the transmitting direction.

10. The dual antenna system as claimed in claim 1, wherein the receiving antenna is a series feeding microstrip antenna.

* * * * *